United States Patent [19]

Siu

[11] Patent Number: 4,792,771

[45] Date of Patent: Dec. 20, 1988

[54] QUADRUPLE MODE FILTER

[75] Inventor: David Siu, Hamilton, Canada

[73] Assignee: Com Dev Ltd., Cambridge, Canada

[21] Appl. No.: 15,061

[22] Filed: Feb. 17, 1987

[30] Foreign Application Priority Data

Feb. 21, 1986 [CA] Canada ..... 502403

[51] Int. Cl.[4] ..... H01P 1/207; H01P 1/208

[52] U.S. Cl. ..... 333/208; 333/209; 333/212

[58] Field of Search ..... 333/208, 209, 212, 227, 333/230

[56] References Cited

U.S. PATENT DOCUMENTS

| | | | |
|---|---|---|---|
| 2,890,421 | 6/1959 | Currie | 333/208 |
| 4,410,865 | 10/1985 | Young et al. | 333/208 |
| 4,439,747 | 3/1984 | Kreinheder et al. | 333/212 X |
| 4,630,009 | 12/1986 | Tang | 333/212 X |
| 4,644,305 | 2/1987 | Tang et al. | 333/208 |

FOREIGN PATENT DOCUMENTS

| | | | |
|---|---|---|---|
| 1194157 | 9/1985 | Canada | 333/212 |
| 0099547 | 8/1979 | Japan | 333/209 |

*Primary Examiner*—Eugene R. LaRoche
*Assistant Examiner*—Benny T. Lee
*Attorney, Agent, or Firm*—Daryl W. Schnurr

[57] ABSTRACT

A quadruple mode bandpass filter has at least one cavity resonating in four independent orthogonal modes simultaneously. Preferably, the filter has two cavities, one cavity being a quadruple mode cavity and the remaining cavity being either a single mode, dual mode, triple mode or quadruple mode cavity. By introducing a resonant feedback coupling into filters of the present invention, the number of transmission zeros produced by the filter is equal to the order of the filter. Previous filters have cavities resonating in either a single, dual or triple mode and the maximum number of transmission zeros is equal to the order of the filter minus two.

29 Claims, 15 Drawing Sheets

Frequency (GHz)

LEGEND

——————— Isolation

—— – —— Return Loss

QUADRUPLE MODE FILTER

BACKGROUND OF THE INVENTION

1. Field of the Invention

This invention relates to a quadruple mode bandpass filter and, in particular, to a filter that has at least one cavity resonating in four independent orthogonal modes simultaneously.

2. Description of the Prior Art

It is known to have single, dual and triple mode bandpass filters. At the present time in the satellite communications industry, it is common to use 4-pole or 6-pole dual mode filters in output multiplexers and 8-pole dual mode filters in input multiplexers. Thus, by this arrangement, output multiplexers have either two or three cascade waveguide cavities and input multiplexers have four cascade waveguide cavities. In the satellite communications industry, any weight or volume savings achieved are extremely important. Filters currently used for input and output multiplexers are generally significantly heavier and occupy a much larger volume than filters made in accordance with the present invention. Further, it is known to use two triple mode cavities as a 6-pole filter in an output multiplexer. Unfortunately, this type of 6-pole filter must be launched onto a manifold of the multiplexer at a sidewall of one of the triple mode cavities. This side-wall launching can be much bulkier than an end-wall launching.

For some time, it has been known that if a filter can be made to produce more transmission zeros, the response of that filter will be enhanced. With previous filters, the maximum number of transmission zeros that can be produced is equal to the order of the filter minus two. For example, a six-pole prior art dual mode filter can be made to produce four transmission zeros and such a filter is said to produce an elliptic function response.

A bandpass filter having at least one four mode cavity, with tuning screws and coupling screws arranged in said filter so that said four mode cavity resonates at its resonant frequency in four independent orthogonal modes simultaneously. Any additional cavities to said four mode cavity are immediately adjacent to one another or to said four mode cavity. At least one of any additional cavities in immediately adjacent to said four mode cavity. Any immediately adjacent cavities are coupled to one another and resonating at their resonant frequency, said fliter having an input and output.

Preferably, the filter of the present invention has at least two cavities, a first cavity being a quadruple mode cavity and a second cavity being either a single mode cavity, a dual mode cavity, a triple mode cavity or a quadruple mode cavity. Still more preferably, the filter of the present invention is operated in such a manner that the number of transmission zeros is equal to the order of the filter.

BRIEF DESCRIPTION OF THE DRAWINGS

In drawings which illustrate a preferred embodiment of the invention.

DESCRIPTION OF A PREFERRED EMBODIMENT

Figure 1:
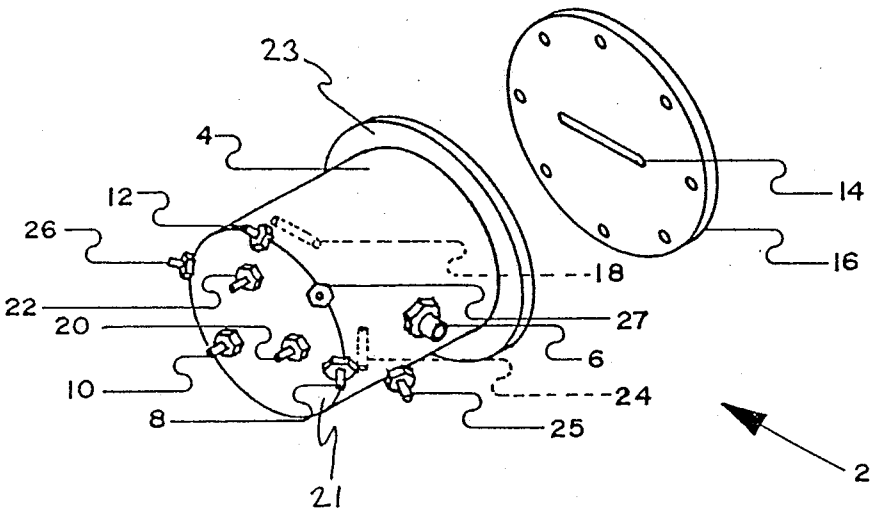
FIG. 1 is an exploded perspective view of a single cavity quadruple mode filter having an input coupling probe.

Referring to the drawings in greater detail, in FIG. 1 there is shown a 4-pole elliptic filter 2 having one cavity 4 resonating at its resonant frequency in four independent orthogonal modes simultaneously. The cavity 4 can be made to resonate in a first $TE_{113}$ mode, a second $TM_{110}$ mode, a third $TM_{110}$ mode and a fourth $TE_{113}$ mode. Electromagnetic energy is introduced into the cavity 4 through input coupling probe 6 which excites an electric field of the first $TE_{113}$ mode. Energy from the first $TE_{113}$ mode is coupled to the second $TM_{110}$ mode by coupling screw 8. Energy is coupled from the second $TM_{110}$ mode to the third $TM_{110}$ mode and from the third $TM_{110}$ mode to the fourth $TE_{113}$ mode by coupling screws 10, 12 respectively. Energy is coupled out of the cavity 4 by means of a magnetic field transfer through aperture 14 in iris 16. Tuning screws 18, 20, 22 and 24 control the resonant frequencies of the first $TE_{113}$ mode, the second $TM_{110}$ mode, the third $TM_{110}$ mode and the fourth $TE_{113}$ mode, respectively.

The input coupling probe 6 is located in a side of the cavity 4, mid-way between two end-walls 21, 23 thereof. The tuning screw 18 for the first $TE_{113}$ mode is located in a side of the cavity 4 directly opposite the input 6. The tuning screw 20 for the second $TM_{110}$ mode is located in the same plane, tranverse to the end wall 21, 23, as the input 6 and the tuning screw 18 and is located in the first end-wall 21 of said cavity 4 mid-way along a radius extending from a center of said end-wall 21 toward the same side as said input 6. The tuning screw 22 for the third $TM_{110}$ mode is located in the first end-wall 21 mid-way along a radius from a center of said end wall that is 90 degrees from the tuning screw 20 for the second $TM_{110}$ mode. The tuning screw 24 for the fourth $TE_{113}$ mode is located in a side of the cavity midway between the end-walls 21, 23 and 90 degrees from the input 6 and the tuning screw 18 said tuning screw 24 being 180 degrees from the tuning screw 22.

Coupling screw 8 is at a 45 degree angle to tuning screws 18, 20 while coupling screw 12 is at a 45 degree angle to tuning screws 22, 24. Coupling screw 10 is 135 degrees from each of tuning screws 20, 22 on an imaginary circle formed by screws 10, 20, 22. While the filter 2 is described as resonating in 4 specific modes, it should be noted that the cavity 4 is cylindrical in shape and the cavity 4 can be made to resonate in two orthogonal $TM_{110}$ modes and two $TE_{11}N$ modes, where N is a positive integer. In the specific modes described above, N is equal to 3.

Coupling screw 25 is located in the cavity 4 at a 45 degree angle to tuning screws 18, 24 of the first and fourth modes respectively, thereby creating a negative feedback coupling between the first and fourth modes (ie. $M_{14}$). This negative feedback coupling gives rise to a pair of transmission zeros.

Due to the geometry of the cavity 4, there are always inherent stray feedback couplings between the first $TE_{113}$ mode and the third $TM_{110}$ mode (ie. $M_{13}$) and between the second $TM_{110}$ mode and the fourth $TE_{113}$ mode (ie. $M_{24}$). These stray feedback couplings are undesirable for symmetrical filter responses. Therefore decoupling screws 26, 27 are located on the cavity 4 to cancel out the stray feedback couplings $M_{13}$ and $M_{24}$ in order to preserve the symmetry of the filter response. The decoupling screws 26, 27 are at a 45 degree angle with respect to the screw 12 on either side of said screw 12.

Figure 1A:
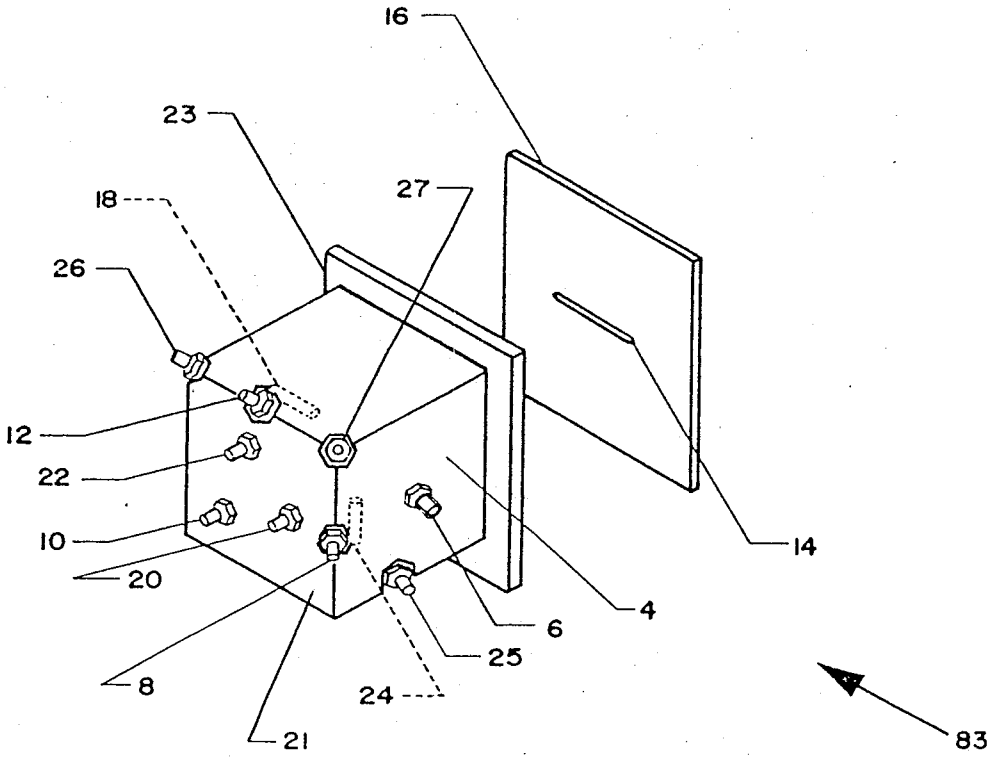
FIG. 1*a* is the same filter with a square or rectangular cross-section cavity.

In FIG. 1*a*, there is shown a 4-pole elliptic filter 83 whose resonant cavity 4 has a square or slightly rectangular cross-section. Except for the shape of the cavity 4, the filter 83 is identical to the filter 2 and the same reference numerals are used for FIG. 1*a* as those in FIG. 1. The operation of this filter is identical to the filter 2 previously discussed with the exception that the cavity 4 can be made to resonate in two orthogonal $TM_{210}$ modes and two orthogonal $TE_{10N}$ modes, where N is a positive integer. Preferably, the filter 83 resonates in the $TE_{103}$ and $TM_{210}$ modes.

Figure 2:
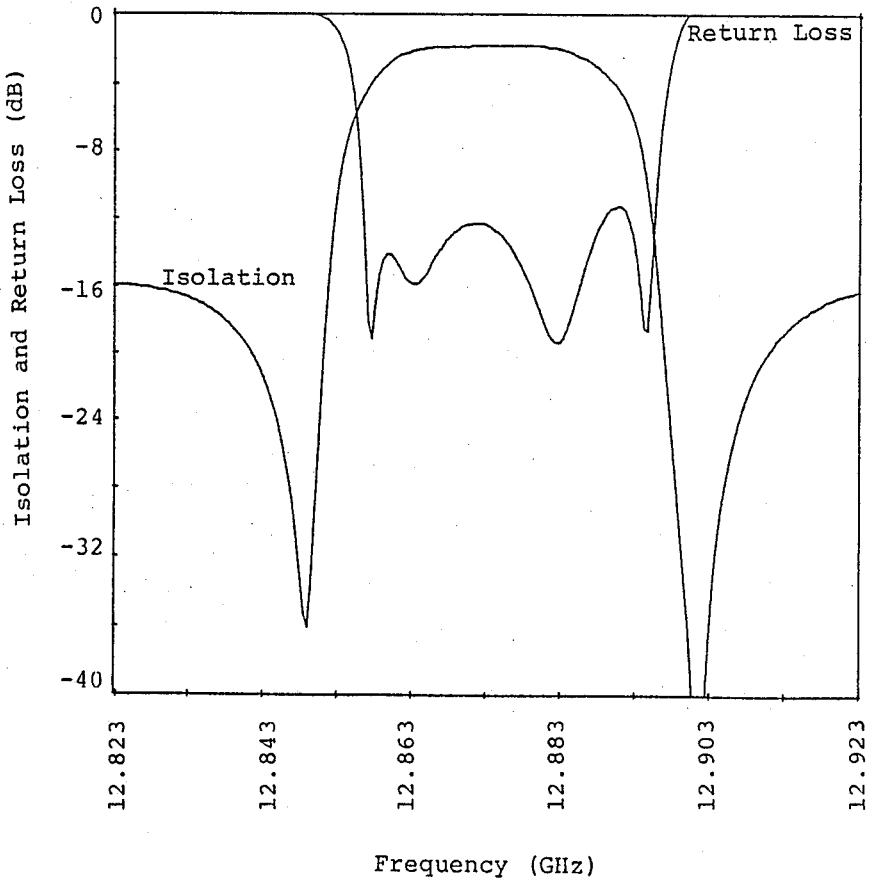
FIG. 2 is a graph showing the isolation and return loss responses of the filters shown in FIGS. 1 and 1*a;*

In FIG. 2, there is shown the isolation and return loss responses of the filter 2 of FIG. 1. It can be seen that the 4-pole filter 2 has two transmission zeros.

Figure 3:
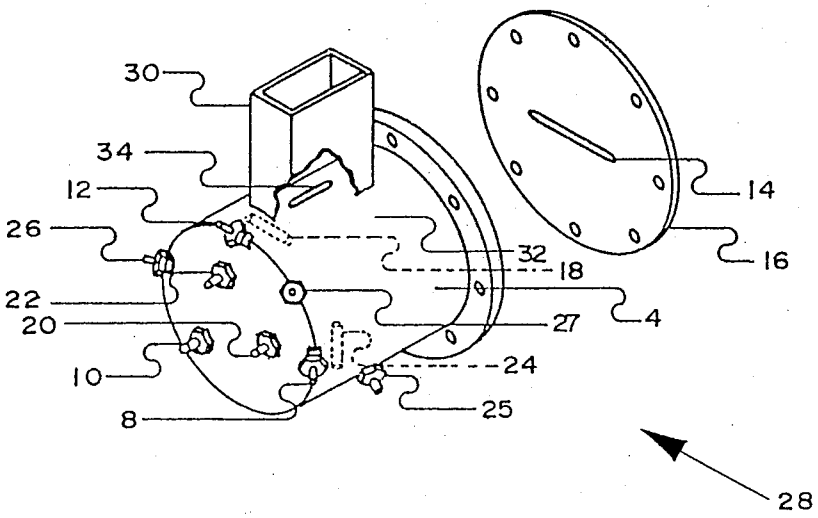
FIG. 3 is an exploded perspective view of a quadruple mode filter having an input aperture.

In FIG. 3, there is shown a filter 28, which is virtually identical to the filter 2 shown in FIG. 1, except for the type of input. Both components of the filter 28 that are similar or identical to components of the filter 2 are referred to by the same reference numerals as those used in FIG. 1. The filter 28 has a waveguide input 30 mounted on a side-wall 32 of the cavity 4. An aperture 34 is located in the side-wall 32 and input coupling is achieved by means of magnetic field transfer to the first $TE_{113}$ mode through said aperture 34. Since the remaining components of the filter 28 are identical to those of the filter 2, those components are not further discussed.

Figure 4:
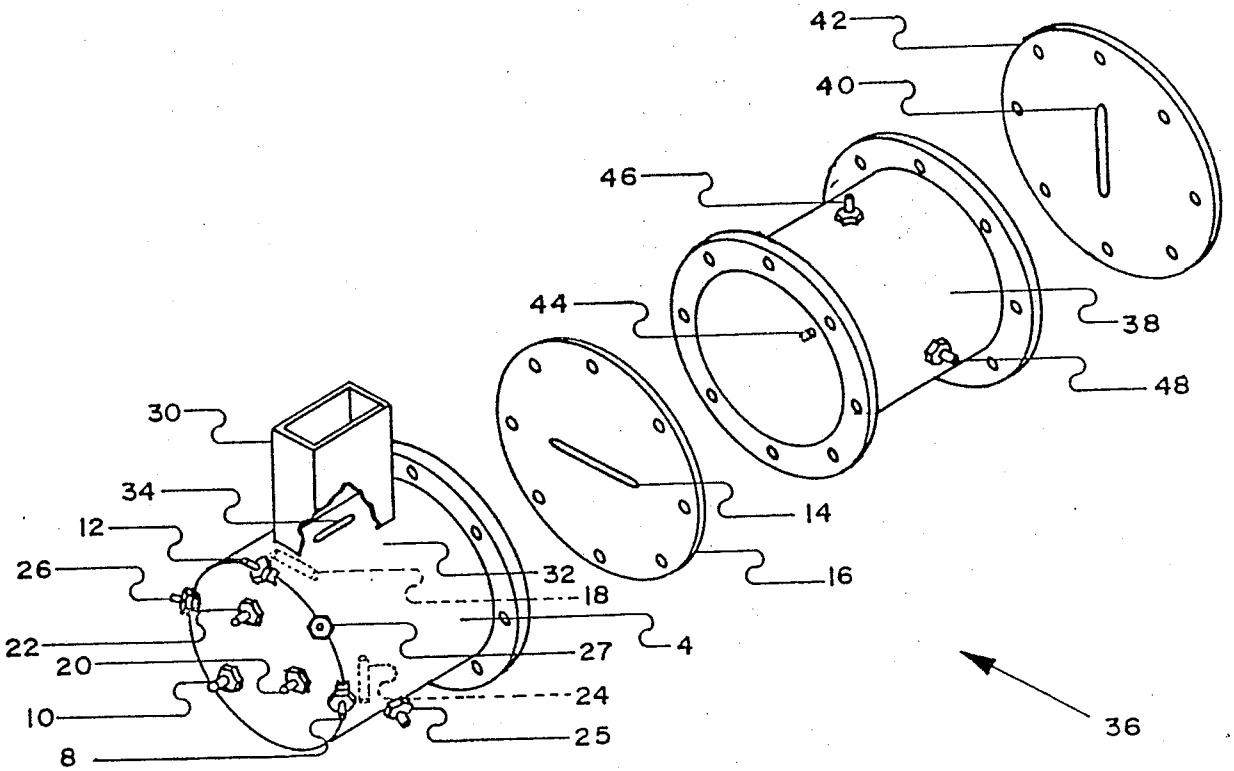
FIG. 4 is an exploded perspective view of a 6-pole filter with one quadruple mode cavity and one dual mode cavity mounted in cascade.

In FIG. 4, there is shown a 6-pole quasielliptic filter 36 having a quadruple mode cavity 4 mounted in cascade with a dual mode cavity 38. The quadruple mode cavity 4 is identical to the cavity 4 of FIG. 3 and therefore the same reference numerals are used for the components of the cavity 4 of filter 36 as those used for the components of the cavity 4 of the filter 28. The cavity 38 is a dual mode cavity having an output through an aperture 40 located in an iris 42. The cavity 4 is mounted immediately adjacent to the dual-mode cavity 38.

In the operation of the filter 36, input coupling aperture 34 couples magnetic field energy into the cavity 4 to excite, in turn, a first $TE_{113}$ mode, a second $TM_{110}$ mode, a third $TM_{110}$ mode and a fourth $TE_{113}$ mode. Coupling screws 8, 10, 12, 25, tuning screws 18, 20, 22, 24 and decoupling screws 26, 27 operate in the same manner as the filter 28 and as previously described for the filter 2 of FIG. 1. The cavity 38 resonates in two independent $TE_{113}$ modes. Inter-cavity coupling between the fourth $TE_{113}$ mode of the cavity 4 and the fifth $TE_{113}$ mode of the cavity 38 can occur through the aperture 14 of the iris 16. In cavity 38, coupling screw 44 is located at a 45 degree angle to tuning sceews 46, 48 and thereby couples energy from the fifth $TE_{113}$ mode to the sixth $TE_{113}$ mode. Energy is coupled out of the sixth $TE_{113}$ mode and out of the filter 36 by means of a magnetic field transfer through the aperture 40 of iris 42.

Figure 5:
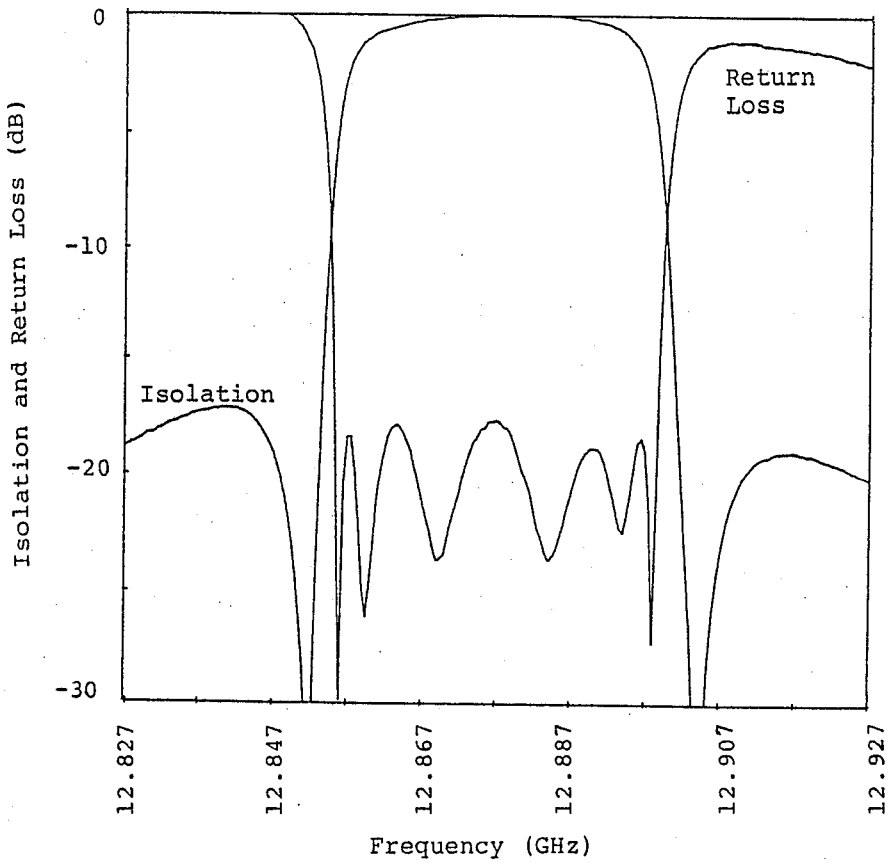
FIG. 5 is a graph showing the isolation response and return loss for the filters shown in FIGS. 4 and 4*a;*

As with the filter 28, the filter 36 has one negative feedback coupling (ie.$M_{14}$), giving rise to one pair of transmission zeros. In FIG. 5, there is shown the isolation and return loss responses of the filter 36 of FIG. 4.

Figure 4A:
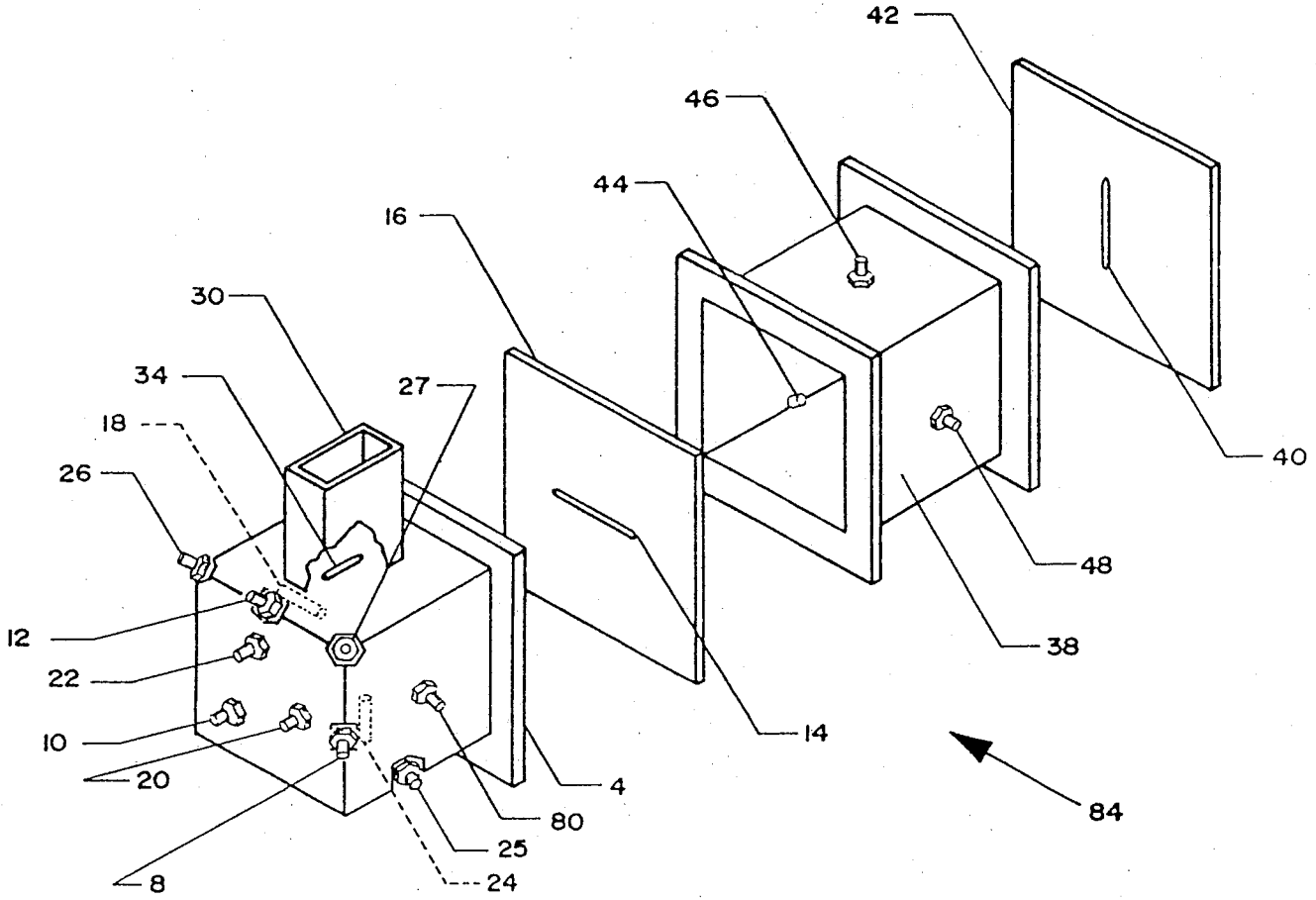
FIG. 4*a* is the same filter employing cavities of square or rectangular cross-section.

In FIG. 4*a*, there is shown a 6-pole quasielliptic filter 84 which is identical to the filter 36 with the exception that square cross-sectional cavities are used. The same reference numerals are used in FIG. 4*a* as those used in FIG. 4. The operation of the filter 84 is identical to the filter 36 except that $TM_{210}$ and $TE_{10}N$ are the resonant modes where N is a positive integer.

Figure 6:
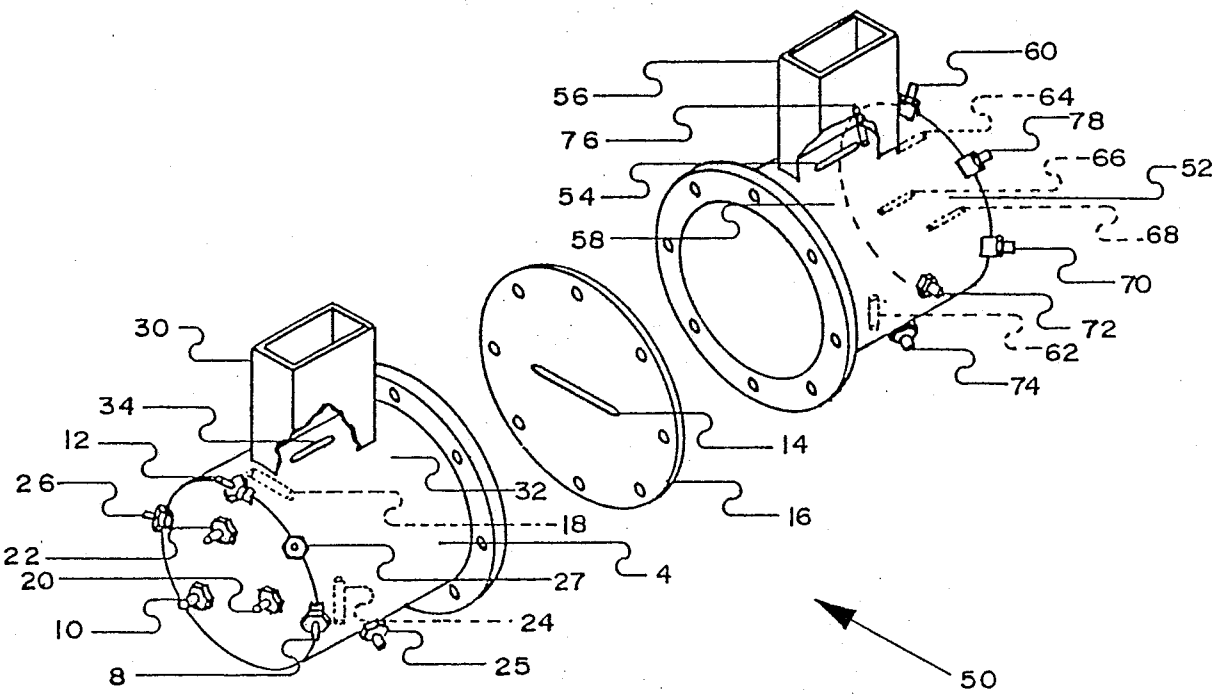
FIG. 6 is an exploded perspective view of an 8-pole filter having two quadruple mode cavities mounted in cascade.

In FIG. 6, there is shown an 8-pole quasielliptic filter 50 having a cascade of two quadruple mode cavities 4, 52. The cavity 4 is the input cavity and is identical to the cavity 4, previously described for filters 28 and 36. For this reason, the same reference numerals are used for the cavity 4 of the filter 50 as those used for the cavity 4 of the filters 28 and 36. In operation of the filter 50, the input coupling aperture 34 couples magnetic field energy into the cavity 4 to excite, in trrn, a first $TE_{113}$ mode, a second $TM_{110}$ mode, a third $TM_{110}$ mode and a fourth $TE_{113}$ mode. As with the filter 36 of FIG. 4 and as previously described with respect to the filter 2 of FIG. 1, the tuning and coupling screws of the cavity 4 of the filter 50 operate in a similar manner to those of the cavity 4 of the previously described filters. Energy is coupled out of the filter 50 through an aperture 54 located in a sidewall 58 of the cavity 52. The aperture 54 is located inside an input waveguide opening 56 that is mounted on said side-wall 58. The cavity 52 resonates at its resonant frequency in four independent orthogonal modes simultaneously. Inter-cavity magnetic energy coupling occurs between the fourth $TE_{113}$ mode of the cavity 4 and the fifth $TE_{113}$ mode of the cavity 52 through the aperture 14 of the iris 16. The two quadruple mode cavities 4, 52 are mounted immediately adjacent to one another.

Coupling screw 60 of cavity 52 is at an angle to tuning screws 62, 64 and couples energy from the fifth $TE_{113}$ mode to a sixth $TM_{110}$ mode. The sixth $TM_{110}$ mode is coupled to a seventh $TM_{110}$ mode through coupling screw 66 which is located 135 degrees from each of tuning screws 64, 68 on an imaginary circle formed by screws 64, 66, 68. Energy is coupled from the seventh $TM_{110}$ mode to an eighth $TE_{113}$ mode by means of coupling screw 70, which is located at a 45 degree angle between tuning screws 68, 72. Tuning screws 62, 64, 68 and 72 control the resonant frequencies of the fifth $TE_{113}$ mode, the sixth $TM_{110}$ mode, the seventh $TM_{110}$ mode and the eighth $TE_{113}$ mode, respectively.

Energy is coupled out of the cavity 52 and out of the filter 50 through the aperture 54.

Figure 6A:
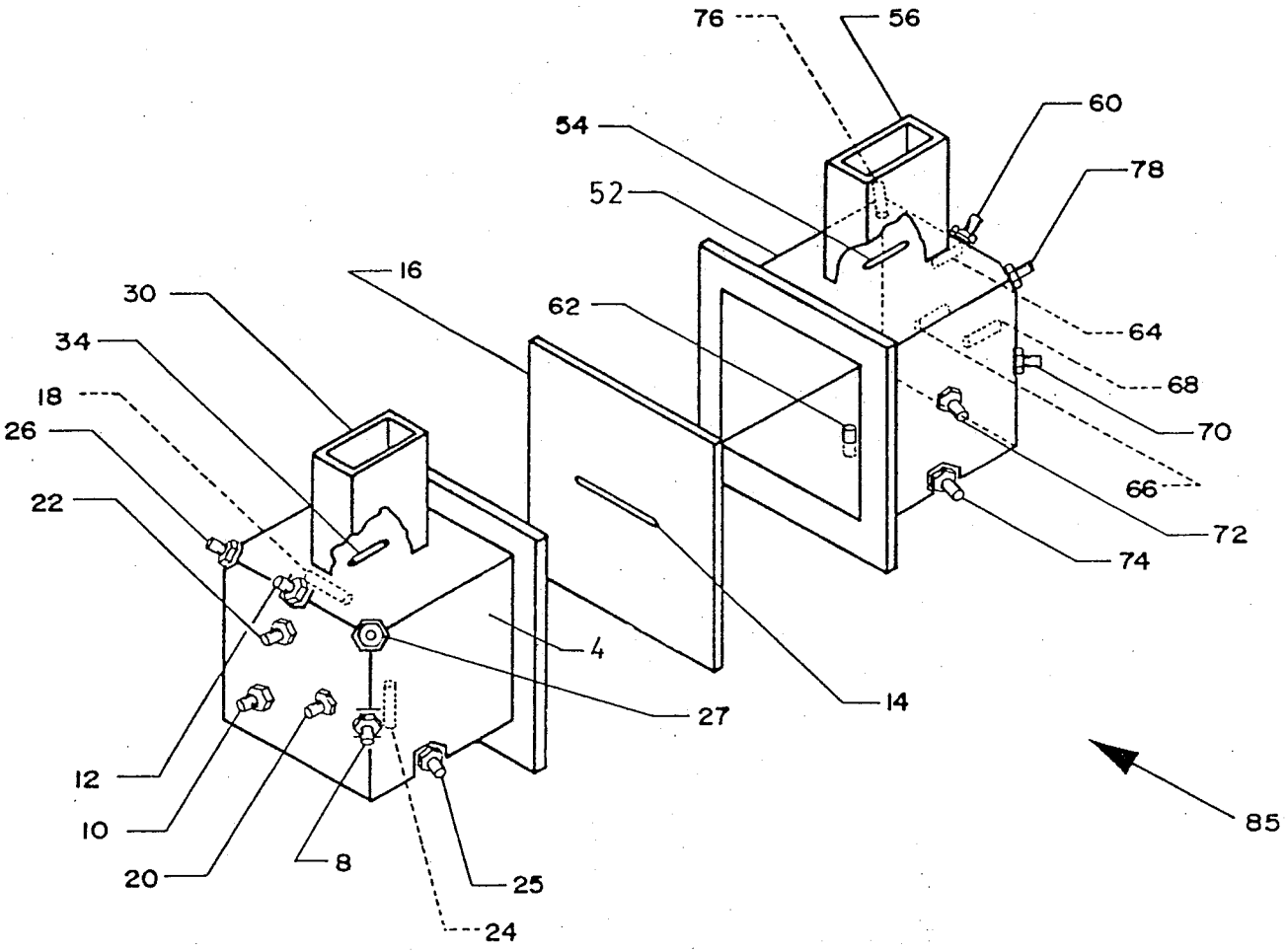
FIG. 6*a* is the same filter employing cavities of square or rectangular cross-section.

In FIG. 6A, there is shown an 8-pole quasi-elliptic filter 85 having in cascade, two quadruple mode cavities 4, 52. The filter 85 is identical to the filter 50 with the exception that square cross-sectional cavities are used. The same reference numerals are used in FIG. 6A to those used in FIG. 6. The operation of the filter 85 is identical to that of the filter 50 except that $TM_{210}$ and $TE_{10N}$ are the resonant modes where N is a positive integer.

Figure 7:
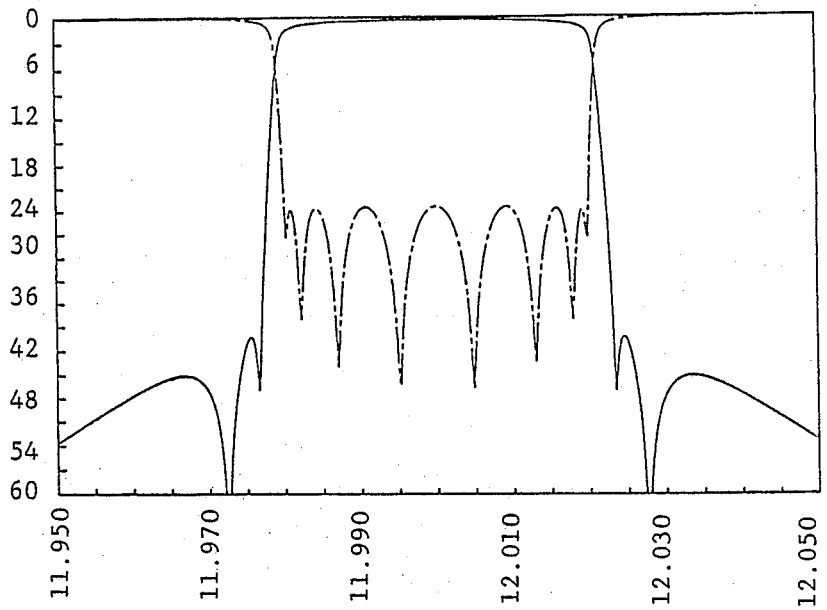
FIG. 7 is a graph showing the return loss and isolation responses of the filters shown in FIGS. 6 and 6*a;*

There are two negative feedback couplings for the 8-pole filter 50. These feedback couplings give rise to two pairs of transmission zeros. The first negative feedback coupling is similar to that described for filter 28 of FIG. 3 (ie. $M_{14}$). The second feedback coupling is provided by coupling screw 74 located between the fifth $TE_{113}$ mode (ie. $M_{58}$). The four transmission zeros are readily apparent on the isolation and return loss responses of the filter 50 shown in FIG. 7.

Decoupling screws 76, 78 on cavity 52 are used to cancel out inherent stray feedback couplings between the fifth $TE_{113}$ mode and the seventh $TM_{110}$ mode (ie. $M_{57}$) and between the sixth $TM_{110}$ mode and the eighth $TE_{113}$ mode (ie. $M_{68}$) respectively. Decoupling screws 76, 78 of the cavity 52 operate in a similar manner to decoupling screws 26, 27 of the cavity 4, as previously described.

While the filter 2 of FIG. 1 has an input through a coupling probe 6 and an output through an aperture 14 and the filter 28 of FIG. 3 has apertures for the input and output, a filter could have coaxial probes for the input and output.

A filter in accordance with the present invention could have at least two cavities where one cavity resonates at its resonant frequency in four independent orthogonal modes simultaneously and another cavity is either a single mode cavity, a dual mode cavity, a triple mode cavity or a quadruple mode cavity. Similarly, a two cavity filter in accordance with the present invention could have one quadruple mode cavity in combination with either a single mode, dual mode, triple mode or quadruple mode cavity. In any of these filters, a coupling screw can be arranged in each of the quadruple mode cavities to create a negative feedback coupling between a first mode and a fourth mode, thereby giving rise to two transmission zeros. Where the filter has more than one quadruple mode cavity, the negative feedback coupling is created between a first and fourth mode of each cavity. For example, in a two cavity filter where each cavity resonates at its resonant frequency in four independent orthogonal modes simultaneously, the negative feedback coupling in the first cavity is $M_{14}$ and in the second cavity is $M_{58}$. In other words, the fifth mode of the filter is the first mode of the second cavity and the eighth mode of the filter is the fourth mode of the second cavity.

Figure 8:
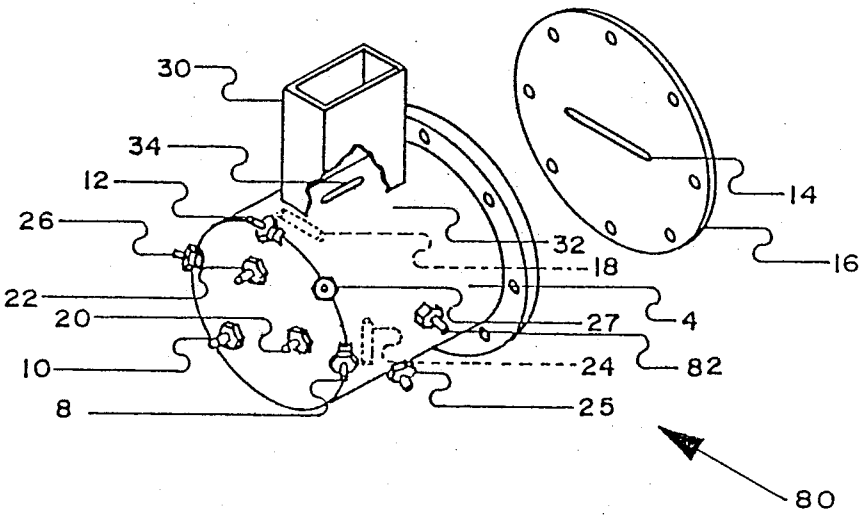
FIG. 8 is a single cavity quadruple mode filter that can be operated in such a way as to realize four transmission zeros.

In FIG. 8, there is shown a single cavity 4-pole quadruple mode filter 80 that can be operated in such a manner as to realize four transmission zeros, two transmission zeros are created, as previously described with respect to the filter 2 of FIG. 1, by the negative feedback coupling $M_{14}$. By adding a resonant feedback coupling betwen the first $TE_{113}$ mode and the third $TM_{110}$ mode (ie. $M_{13}$), two more transmission zeros can be obtained. This results in the 4-pole filter 80 having a total of four transmission zeros. A resonant feedback coupling is one that changes sign at the resonant frequency of the filter, being negative below the resonant frequency and positive above the resonant frequency.

Figure 9:
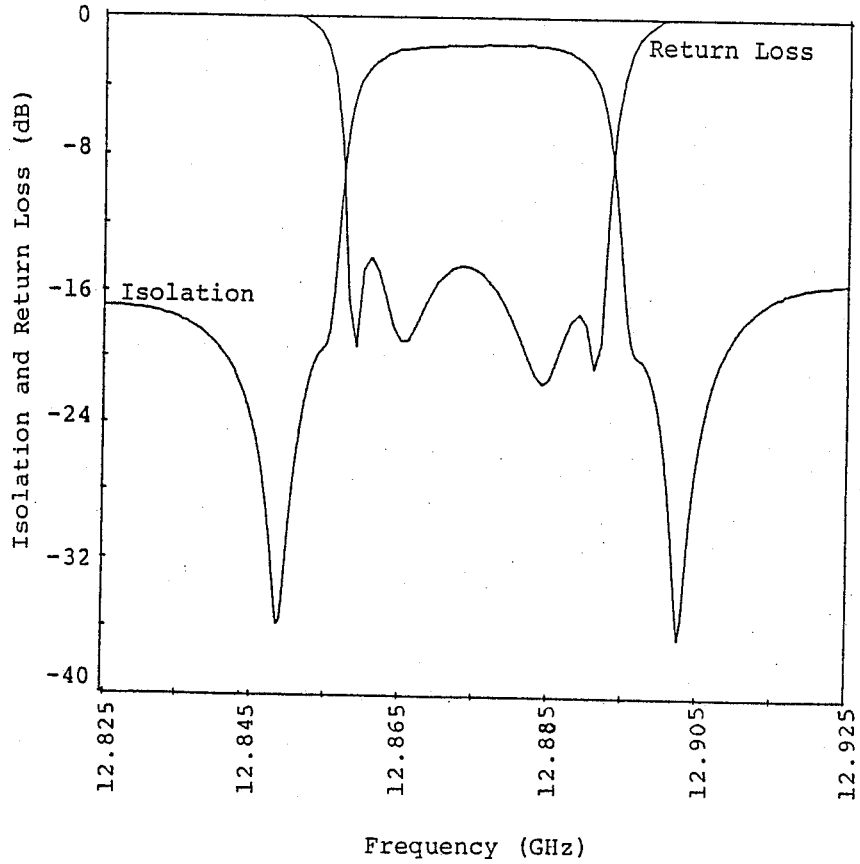
FIG. 9 is a graph showing the isolation and return loss responses of the filter shown in FIG. 8.

Filter 80 is virtually identical to filter 28 in FIG. 3 except for an extra tuning screw 82 for the first $TE_{113}$ mode. The tuning screw 82 is located directly opposite to the tuning screw 18 which also controls the resonant frequency of the first $TE_{113}$ mode. The remaining components of the filter 80 are identical to those of the filter 28 and the same reference numerals are used for the filter 80 for those components that are identical to the components of the filter 28. Screw 26, which is used in the filter 28 to decouple or cancel stray coupling between the first $TE_{113}$ mode and third $TM_{110}$ mode, has a different use in the filter 80. In the filter 80, screw 26 is used to create and adjust the $M_{13}$ coupling. By balancing the penetration of the tuning screws 18, 82, 22 and the coupling screw 26, a resonant $M_{13}$ coupling can be realized. All other tuning and coupling screws of the filter 80 function in a manner similar to those of the filter 28 of FIG. 3. In FIG. 9, there is shown the isolation and return loss response of the 4-pole elliptic filter 80 with four transmission zeros.

While the filter 80 has only one cavity, it is possible, within the scope of the present invention, to combine a quadruple mode cavity with either a single, dual, triple or a second quadruple mode cavity and to obtain a filter response having the number of transmission zeros equal to the number of poles of the filter. Further, it will be readily apparent to those skilled in the art that other combinations of cavities can be utilized within the scope of the attached claims. For example, a filter having three cascade quadruple mode cavities, can be made to function in such a manner that the number of transmission zeros produced is equal to twelve, being the order of the filter. In other words, a two cavity 8-pole filter can be made to produce eight transmission zeros. A two cavity 6-pole filter having one quadruple mode cavity can be made to produce six transmission zeros.

A filter in accordance with the present invention can have at least two cavities, with at least one cavity resonating at its resonant frequency in four independent orthogonal modes simultaneously and at least one of the remaining cavities being either a single mode cavity, a dual mode cavity, a triple mode cavity or a quadruple mode cavity. These filters can be operated in such a manner that the number of transmission zeros is equal to the order of the filter. Some of the transmission zeros are created in these filters by adding a resonant feedback coupling.

Figure 10:
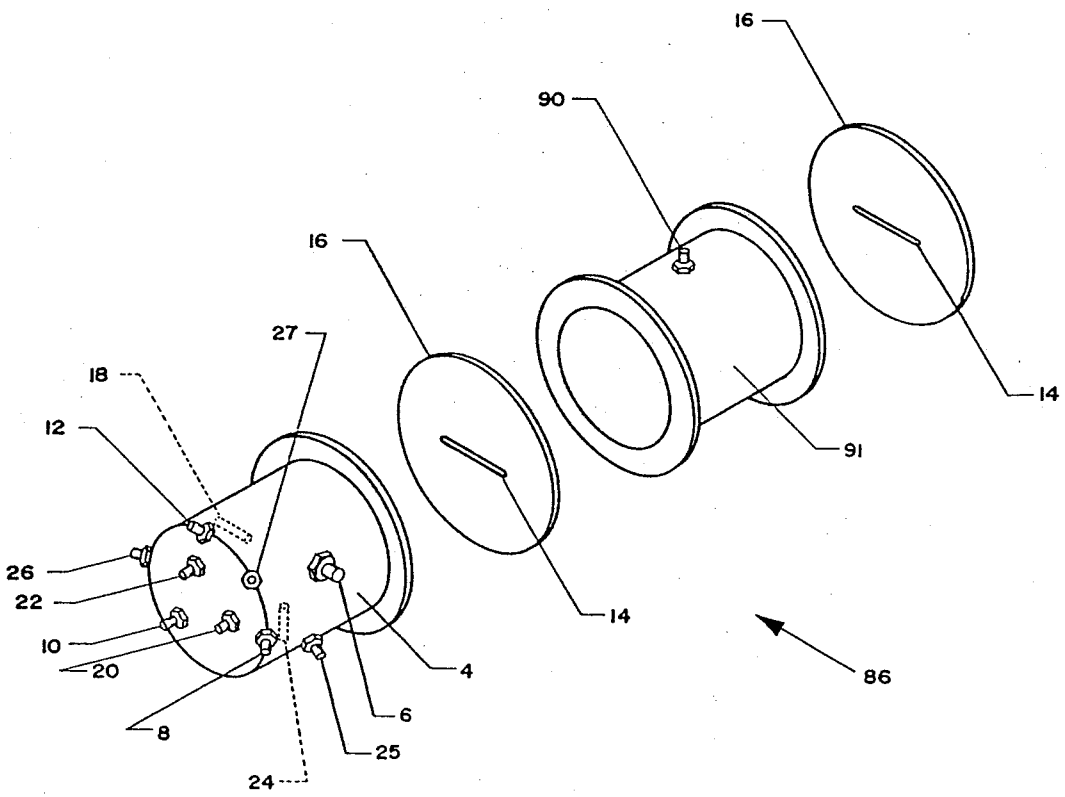
FIG. 10 is an exploded perspective view of a 5-pole filter employing one quadruple mode cavity and one single mode cavity.

FIG. 10 displays a two cavity filter 86 consisting of a quadruple mode cavity 4 and a single mode cavity 91. This filter can be used to realize a five-pole filter response with up to five transmission zeros. The quadruple mode cavity 4 functions as previously described in filter 80 shown in FIG. 8 with the exception that a coaxial probe 6 is used to obtain the input coupling. The same reference numerals are used for the cavity 4 of filter 86 as those used for cavity 4 of filter 80. The fifth $TE_{11N}$ mode, where N is a positive integer, is contained in the cavity 91 with resonant frequency controlled by the tuning screw 90. Energy is coupled to the fifth mode from the fourth $TE_{11N}$ mode, where N is a positive integer, via magnetic field coupling through aperture 14 in iris 16. Four transmission zeros are obtained through the use of feedback coupling $M_{14}$ and resonant feedback coupling $M_{13}$ as previously described. The fifth transmission zero is generated through the use of an $M_{15}$ feedback coupling. This coupling is adjusted by rotating the cavity 91 and the irises 14 about the cavity axis. The quadruple mode cavity 4 and the single mode cavity 91 are mounted immediately adjacent to one another.

Figure 11:
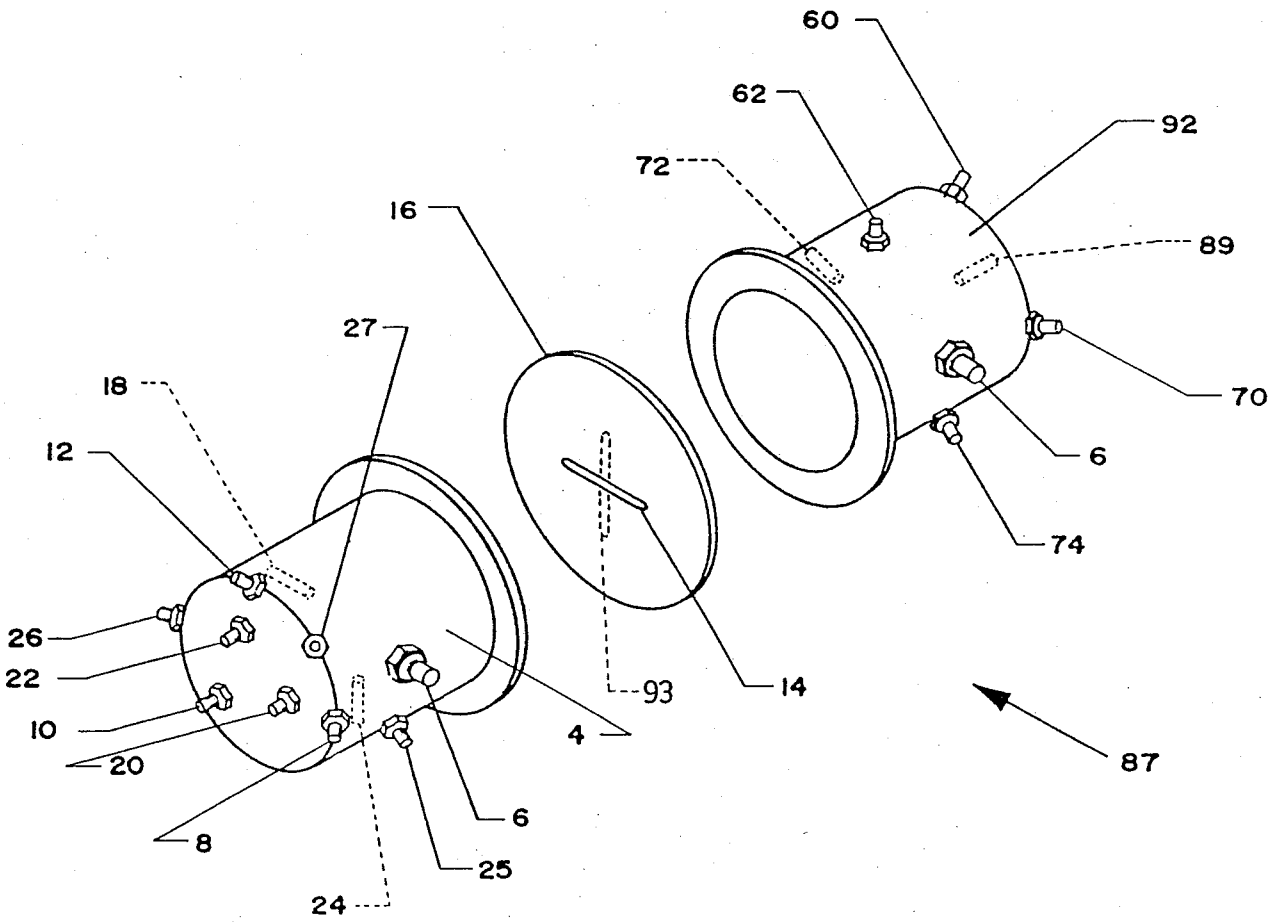
FIG. 11 is an exploded perspective view of a 7-pole filter employing one quadruple mode cavity and one triple mode cavity.

FIG. 11 displays a two cavity filter 87 consisting of a quadruple mode cavity 4 and a triple mode cavity 92. This filter can be used to realize a seven-pole filter response. The quadruple mode cavity 4 functions as previously described for the filter 80 and the same reference numerals are used. Energy from the fourth mode is coupled magnetically through aperture 14 into the fifth $TE_{114}$ mode in cavity 92. Energy is in turn coupled into the sixth $TM_{01,N-1}$ mode, weere N is a positive integer, via coupling screw 60. Energy is coupled into the seventh $TE_{11N}$ mode, where N is a positive integer, via coupling screw 70. Output coupling is obtained through an electric field probe 6. The resonant frequencies of the fifth, sixth and seventh modes are controlled via tuning screws 62, 89 and 72 respectively. Feedback coupling $M_{13}$, $M_{14}$, $M_{57}$ are available controlled by coupling screws 27, 25 and 74 respectively and can be used to create up to four transmission zeros. If feedback couplings $M_{13}$ and $M_{57}$ are made to resonate using the method described for filter 80 previously, then up to six transmission zeros can be obtained with this structure. If, furthermore, the coupling M17 is added by introducing an additional aperture 93 (as shown in phantom in FIG. 11) into iris 16 perpendicular to the aperture 14 then the structure will produce a filter response with seven transmission zeros. The quadruple mode cavity 4 is mounted immediately adjacent to the triple mode cavity 92.

Figure 11A:
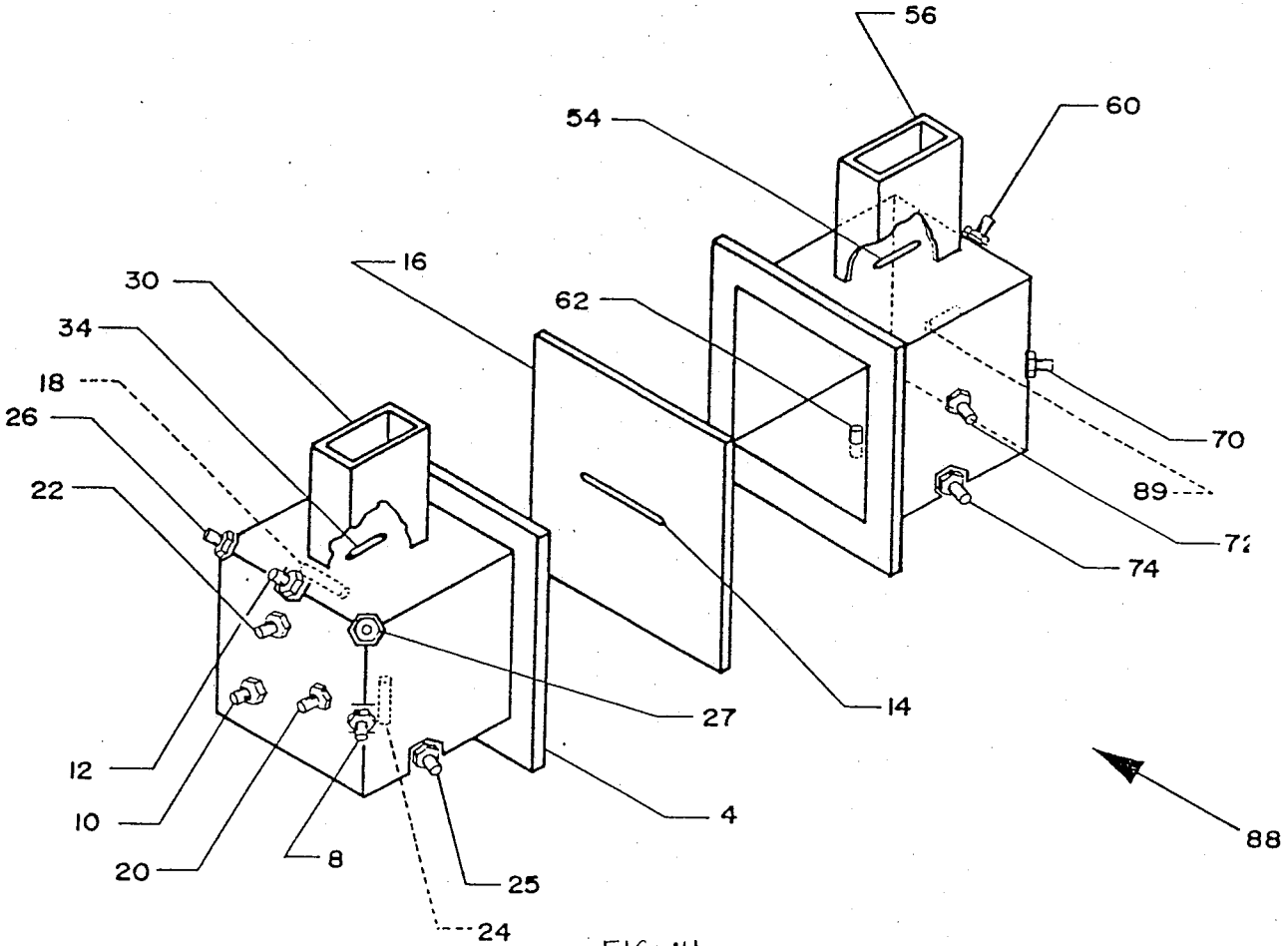
FIG. 11*a* is the same filter employing cavities with a square or rectangular cross-section.

FIG. 11*a* shows a seven-pole two cavity filter 88 which is equivalent to the filter 87 with the exception that square cross-sectional cavities are employed and apertures 34, 54 are employed for the input and output coupling respectively. The operation of the filter 88 and the filter functions obtained are otherwise identical to the filter 87 and will not be further discussed.

It can readily be seen that the present invention can achieve a significant weight and volume saving of approximately 50 percent when a dual mode 4-pole or 8-pole filter is replaced with a 4-pole or 8-pole quadruple mode filter of the present invention. In addition, by cascading a quadruple mode cavity with a dual mode cavity to produce a 6-pole filter, a weight and volume saving of approximately one-third can be achieved over a 6-pole dual mode filter. In addition, a quadruple dual mode 6-pole filter configuration an be launched onto the manifold of an output multiplexer from the end-wall of the dual mode cavity. In this way, the 6-pole filter in accordance with the present invention is more beneficial than a 6-pole filter having two triple mode cavities as a triple mode cavity must be launched onto a manifold through a much bulkier side-wall launching.

What I claim as my invention is:

1. A bandpass filter comprising at least one four mode cavity, with tuning screws and coupling screws arranged in said filter so that said four mode cavity resonates at its resonant frequency in four independent orthogonal modes simultaneously, with any additional cavities to said four mode cavity being immediately adjacent to one another or to said four mode cavity, at least one of any additional cavities being immediately adjacent to said four mode cavity, with any immediately adjacent cavities being coupled to one another and resonating at their resonant frequency, said filter having an input and output.

2. A bandpass filter as claimed in claim 1 wherein all cavities of the filter are cylindrical in shape and adjacent cavities are mounted in cascade relative to one another.

3. A bandpass filter as claimed in claim 2 wherein the quadruple mode cavity resonates in two orthogonal $TM_{110}$ modes and two orthogonal $TE_{11N}$ modes, where N is a positive integer.

4. A bandpass filter as claimed in claim 1 wherein all of the cavities have a square cross-section and adjacent cavities are mounted in cascade relative to one nother.

5. A bandpass filter as claimed in claim 4 wherien the quadruple mode cavity resonates in two orthogonal $TM_{210}$ modes and two orthogonal $TE_{10N}$ modes, where N is a positive integer.

6. A bandpass filter as claimed in claim 3 where N is equal to 3 and the quadruple mode filter resonates in a first $TE_{113}$ mode, a second $TM_{110}$ mode, a third $TM_{110}$ mode and a fourth $TE_{113}$ mode, the input is located in a side of the cavity, midway between two end-walls thereof, a tuning screw for the first mode is located in a side of said cavity directly opposite the input, a tuning screw for the second mode is located in the same plane, transverse to said end walls, as said input and said tuning screw for the first mode and is located in a first end wall of said cavity midway along a radius extending from a centre of said end wall toward the same side as said input, a tuning screw for the third mode is located in said first end wall midway along a radius that is 90 degrees from the tuning screw for the second mode, with a tuning screw for the fourth mode located in a side of the cavity midway between the ends thereof and 90 degrees form the input and the tuning screw for the first mode, said tuning screw for the fourth mode being 180 degrees from said tuning screw for the third mode.

7. A bandpass filter as claimed in any one of claims 1, 3 or 4 wherein there are decoupling screws on each quadruple mode cavity to cancel out stray feedback couplings in order to preserve the symmetry of the filter response.

8. A bandpass filter as claimed in any one of claims 1, 3 or 5 wherein coaxial probes are used for the input and the output of the filter.

9. A bandpass filter as claimed in any one of claims 1, 3 or 5 wherein apertures are used for the input and the output of the filter.

10. A bandpass filter as claimed in any one of claims 1, 3 or 5 wherein the input is a coaxial probe and the output is an aperture.

11. A bandpass filter as llaimed in any one of claims 1, 2 or 3 wherein the filter has at least two cavities mounted immediately adjacent to one another, one of said at least two cavities resonating in a single mode and the other being said four mode cavity.

12. A bandpass filter as claimed in any one of claims 1, 2 or 3 wherein the filter has at least two cavities mounted immediately adjacent to one another, one of said at least two cavities resonating in a dual mode and the other being said four mode cavity.

13. A bandpass filter as claimed in any one of claims 1, 2 or 3 wherein the filter has at least two cavities mounted immediately adjacent to one another, one of said at least two cavities resonating in three independent orthogonal modes simultaneously and the other being said four mode cavity.

14. A bandpass filter as claimed in any one of claims 1, 2 or 3 wherein the filter has at least two cavities mounted immediately adjacent to one another, each of said at least two cavities resonating at its resonant frequency in four independently orthogonal modes simultaneously.

15. A bandpass filter as claimed in any one of claims 4, 5 or 6 wherein the filter has at least two cavities mounted immediately adjacent to one another, one of said at least two cavities resonating in a single mode and the other being said four mode cavity.

16. A bandpass filter as claimed in any one of claims 4, 5 or 6 wherein the filter has at least two cavities mounted immediately adjacent to one another, one of said at least two cavities resonating in a dual mode and the other being said four mode cavity.

17. A bandpass filter as claimed in any one of claims 4, 5 or 6 wherein the filter has at least two cavities mounted immediately adjacent to one another, one of said at least two cavities resonating in three independent orthogonal modes simultaneously and the other being said four mode cavity.

18. A bandpass filter as claimed in any one of claims 4, 5 or 6 wherein the filter has at least two cavities mounted immediately adjacent to one another, each of said at least two cavities resonating at its resonant frequency in four independent orthogonal modes simultaneously.

19. A bandpass filter as claimed in any one of claims 1, 3 or 5 wherein each quadruple mode cavity has a first, second, third and fourth mode and there is a coupling screw located in the quadruple mode cavity at an angle of 45 degrees to the tuning screws for the first and fourth modes, said coupling screw creating a negative feedback coupling between a first mode and a fourth mode of said cavity, said feedback coupling giiving rise to a pair of transmission zeros in the filter response.

20. A bandpass filter as claimed in any one of claims 1, 3 or 5 wherein there are two cavities, each resonating at their resonant frequency in four independent orthongonal modes simultaneously, being a first mode, a second mode, a third mode and a fourth mode, each cavity having a coupling screw arranged to create a negative feedback coupling between a first mode and a fourth mode, thereby giving rise to two transmission zeros in the filter response.

21. A bandpass filter as claimed in any one of claims 1, 2 or 3 wherein the filter can be operated so that the number of transmission zeros in the filter response is equal to the order of the filter.

22. A bandpass filter as claimed in any one of claims 4, 5 or 6 wherein the filter can be operated so that the number of transmission zeros in the filter response is equal to the order of the filter.

23. A bandpass filter as claimed in any one of claims 1, 2 or 3 wherein the filter has one cavity and can be operated so that the number of transmission zeros in the filter response is equal to the order of the filter.

24. A bandpass filter as claimed in claim 1 wherein the filter has at least two cavities mounted immediately adjacent to one another, one of said at least two cavities resonating in a single mode and the other being said four mode cavity, the filter can be operated so that the number of transmission zeros in the filter response is equal to the filter.

25. A bandpass filter as claimed in claim 1 wherein the filter has at least two cavities mounted immediately adjacent to one another, one of said at least two cavities resonating in a dual mode and the other being said four mode cavity, the filter can be operated so that the number of transmission zeros in the filter response is equal to the order of the filter.

26. A bandpass filter as claimed in claim 1 wherein the filter has at least two cavities mounted immediately adjacent to one another, one of said at least two cavities resonating in three independent orthogonal modes simultaneously and the other being said four mode cavity, said filter can be operated so that the number of transmission zeros in the filter response is equal to the order of the filter.

27. A bandpass filter as claimed in claim 1 wherein there are at least two cavities, each resonating at its resonant frequency in four independent orthogonal modes simultaneously and the number of transmission zeros produced by the filter is equal to the order of the filter.

28. A bandpass filter as claimed in any one of claims 24, 25 or 26 wherein a pair of transmission zeros is created by adding a resonant feedback coupling.

29. A bandpass filter as claimed in claim 27 wherein two pairs of transmission zeros are created by adding two resonant feedback couplings.

* * * * *